US010247004B2

(12) United States Patent
Golan et al.

(10) Patent No.: US 10,247,004 B2
(45) Date of Patent: Apr. 2, 2019

(54) HEAT EXCHANGER WITH DECREASED CORE CROSS-SECTIONAL AREAS

(71) Applicant: UNITED TECHNOLOGIES CORPORATION, Farmington, CT (US)

(72) Inventors: John W. Golan, Hebron, CT (US); Frederick M. Schwarz, Glastonbury, CT (US)

(73) Assignee: United Technologies Corporation, Farmington, CT (US)

( * ) Notice: Subject to any disclaimer, the term of this patent is extended or adjusted under 35 U.S.C. 154(b) by 506 days.

(21) Appl. No.: 15/156,382

(22) Filed: May 17, 2016

(65) Prior Publication Data

US 2017/0335690 A1 Nov. 23, 2017

(51) Int. Cl.

| | |
|---|---|
| ***F01D 5/08*** | (2006.01) |
| ***F28D 7/00*** | (2006.01) |
| ***F28D 7/16*** | (2006.01) |
| ***F28F 1/04*** | (2006.01) |
| ***F28F 1/10*** | (2006.01) |

(Continued)

(52) U.S. Cl.

CPC ..... *F01D 5/08* (2013.01); *F01D 25/12* (2013.01); *F04D 29/321* (2013.01); *F28D 7/0025* (2013.01); *F28D 7/1607* (2013.01); *F28D 7/1684* (2013.01); *F28F 1/045* (2013.01); *F28F 1/10* (2013.01); *F28F 13/08* (2013.01); *F05D 2220/32* (2013.01); *F05D 2260/213* (2013.01); *F28D 2021/0026* (2013.01); *F28F 2009/029* (2013.01)

(58) Field of Classification Search

CPC ..... F01D 5/08; F01D 25/12; F04D 29/321; F28D 7/0025; F28D 7/1607; F28D 7/1684; F28D 2021/0026; F28F 1/045; F28F 1/10; F28F 13/08; F28F 2009/029; F05D 2220/32; F05D 2260/213

See application file for complete search history.

(56) References Cited

U.S. PATENT DOCUMENTS 2,214,053 A * 9/1940 Gwinn, Jr. ..... F25D 31/002 165/120

7,203,064 B2 4/2007 Mongia et al.

(Continued)

FOREIGN PATENT DOCUMENTS

| | | |
|---|---|---|
| EP | 2017555 A1 | 1/2009 |
| WO | 2016057443 A1 | 4/2016 |
| WO | 2016057471 A1 | 4/2016 |

OTHER PUBLICATIONS

European Search Report for European Application No. 17171569.1 dated Oct. 27, 2017.

*Primary Examiner* — Richard A Edgar

(74) *Attorney, Agent, or Firm* — Carlson, Gaskey & Olds, P.C.

(57) ABSTRACT

A heat exchanger has a first plurality of fluid passages with an inlet manifold communicating into a core portion, and then an outlet manifold. A second plurality of fluid passages has an inlet manifold communicating into a core portion, and then into an outlet manifold and the core portions of both the first and second pluralities of fluid passages having smaller cross-sectional areas than cross-sectional areas of the inlet and outlet manifolds. A gas turbine engine and a method of forming a heat exchanger are also disclosed.

20 Claims, 7 Drawing Sheets

(51) Int. Cl.

| | |
|---|---|
| ***F28F 9/02*** | (2006.01) |
| ***F01D 25/12*** | (2006.01) |
| ***F04D 29/32*** | (2006.01) |
| ***F28D 21/00*** | (2006.01) |
| ***F28F 13/08*** | (2006.01) |

(56) References Cited

U.S. PATENT DOCUMENTS

| | | | |
|---|---|---|---|
| 7,814,966 | B2 | 10/2010 | Prior |
| 9,010,130 | B2 | 4/2015 | McCormick |
| 9,134,072 | B2 | 9/2015 | Roisin et al. |
| 2010/0243220 | A1 | 9/2010 | Geskes et al. |

* cited by examiner

HEAT EXCHANGER WITH DECREASED CORE CROSS-SECTIONAL AREAS

BACKGROUND OF THE INVENTION

This application relates to a heat exchanger having a unique arrangement of its flow passages.

Heat exchangers are utilized in any number of applications and serve to cool one fluid typically by exchanging heat with a secondary fluid. Historically, heat exchangers have been formed of flow channels which have a relatively constant cross-section, and which also provide a relatively constant surface area per unit of area.

One application for a heat exchanger is in a gas turbine engine. In gas turbine engines, a fan delivers air into a compressor and into a bypass duct as propulsion air. The air from the compressor is compressed and delivered into a combustor where it is mixed with fuel and ignited. Products of this combustion pass downstream over turbine rotors, driving them to rotate.

The turbine section becomes quite hot and, thus, it is known to provide cooling air to the turbine section.

With recent advances in gas turbine engines, the turbine is exposed to hotter temperatures. Further, the turbine is exposed to higher pressures than in the past.

Thus, the cooling air being supplied to the turbine must also have a corresponding increase in pressure. However, when higher pressure air is tapped from the compressor, the temperature also increases.

Thus, the cooling air must be cooled in a heat exchanger before being delivered to the turbine section. Known heat exchangers face challenges in providing adequate cooling.

SUMMARY OF THE INVENTION

In a featured embodiment, a heat exchanger has a first plurality of fluid passages with an inlet manifold communicating into a core portion, and then an outlet manifold. A second plurality of fluid passages has an inlet manifold communicating into a core portion, and then into an outlet manifold and the core portions of both the first and second pluralities of fluid passages having smaller cross-sectional areas than cross-sectional areas of the inlet and outlet manifolds.

In another embodiment according to the previous embodiment, transition portions transition between the inlet manifold and the core portion and between the core portion and the outlet manifold for both the first and second pluralities of fluid passages.

In another embodiment according to any of the previous embodiments, the first plurality of fluid passages and second plurality of fluid passages each have cross-sectional areas which are smaller in the core portion than adjacent the inlet and outlet manifolds.

In another embodiment according to any of the previous embodiments, the inlet and outlet manifolds of one of the first and second pluralities of fluid passages communicate with a turning section which turns into the transition portion, and the other of the first and second set of pluralities of fluid passages extends generally along a common direction with a flow direction through the transition portion.

In another embodiment according to any of the previous embodiments, the first and second pluralities of fluid passages are formed with undulations in the core portion.

In another embodiment according to any of the previous embodiments, the heat exchanger is a cross-flow heat exchanger, with the flow in one of the first and second plurality of fluid passages being generally perpendicular to a flow direction through the other of the first and second plurality of fluid passages.

In another embodiment according to any of the previous embodiments, the inlet and outlet manifolds of one of the first and second pluralities of fluid passages communicates with a turning section which turns into a transition portion, and the other of the first and second set of pluralities of fluid passages communicating generally along a common direction with a flow direction through the core portions.

In another embodiment according to any of the previous embodiments, the first and second pluralities of fluid passages are formed with undulations in the core portion.

In another embodiment according to any of the previous embodiments, the heat exchanger is a cross-flow heat exchanger, with the flow in one of the first and second plurality of fluid passages being generally perpendicular to a flow direction through the other of the first and second plurality of fluid passages.

In another featured embodiment, a gas turbine engine has a compressor section and a turbine section. A heat exchanger cools air from the compressor section being passed to the turbine section. The heat exchanger includes a first plurality of fluid passages having an inlet manifold communicating into a core portion, and then an outlet manifold. A second plurality of fluid passages has an inlet manifold communicating into a core portion, and then into an outlet manifold and the core portions of both the first and second pluralities of fluid passages having smaller cross-sectional areas than cross-sectional areas adjacent the inlet and outlet manifolds.

In another embodiment according to the previous embodiment, transition portions transition between the inlet manifold and the core portion and between the core portion and the outlet manifold for both the first and second pluralities of fluid passages.

In another embodiment according to any of the previous embodiments, the first plurality of fluid passages and second plurality of fluid passages each having cross-sectional areas which are smaller in the core portion than adjacent the inlet and outlet manifolds.

In another embodiment according to any of the previous embodiments, the inlet and outlet manifolds of one of the first and second pluralities of fluid passages communicates with a turning section which turns into the transition portion, and the other of the first and second set of pluralities of fluid passages communicating generally along a common direction with a flow direction through the transition portion.

In another embodiment according to any of the previous embodiments, the first and second pluralities of fluid passages are formed with undulations in the core portion.

In another embodiment according to any of the previous embodiments, the heat exchanger is a cross-flow heat exchanger, with the flow in one of the first and second plurality of fluid passages being generally perpendicular to a flow direction through the other of the first and second plurality of fluid passages.

In another embodiment according to any of the previous embodiments, the first plurality of fluid passages and second plurality of fluid passages each having cross-sectional areas which are smaller in the core portion than adjacent the inlet and outlet manifolds.

In another embodiment according to any of the previous embodiments, the first and second pluralities of fluid passages are formed with undulations in the core portion.

In another featured embodiment, a method of forming a heat exchanger includes forming a first plurality of fluid passages having an inlet manifold communicating into a core portion, and then an outlet manifold, and forming a second plurality of fluid passages having an inlet manifold communicating into a core portion, and then into an outlet manifold and the core portions of both the first and second pluralities of fluid passages having smaller cross-sectional areas than cross-sectional areas adjacent the inlet and outlet manifolds.

In another embodiment according to the previous embodiment, loss mold refractory metal cores are utilized to form the first and second plurality of fluid passages.

In another embodiment according to any of the previous embodiments, additive manufacturing techniques are utilized to form the first and second plurality of fluid passages.

These and other features may be best understood from the following drawings and specification.

DETAILED DESCRIPTION

Figure 1:
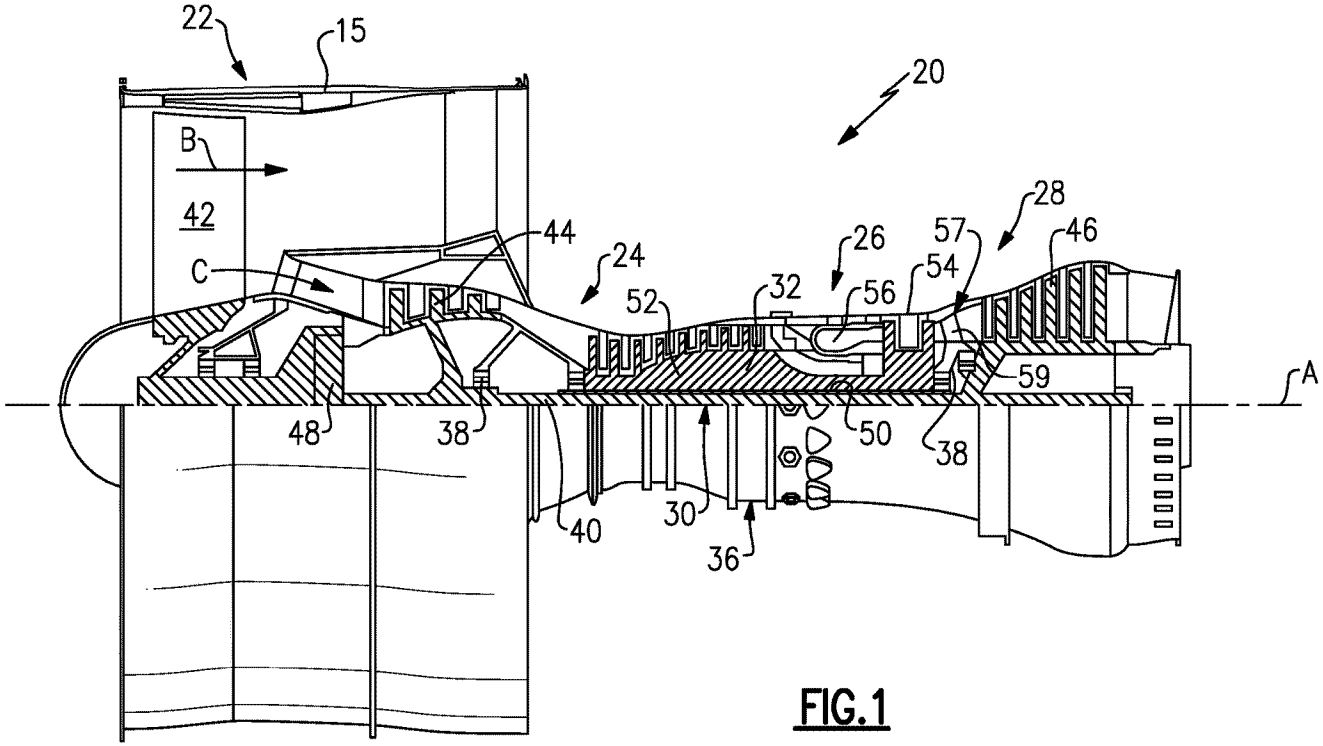
FIG. 1 schematically shows an engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram °R})/(518.7\text{°R})]^{0.5}$. The "Low corrected fan tip speed" as disclosed herein according to one non-limiting embodiment is less than about 1150 ft/second (350.5 meters/second).

Figure 2:
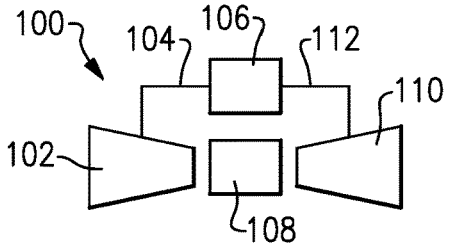
FIG. 2 is a highly schematic view of an engine.

FIG. 2 schematically shows an engine 100 having a compressor 102 delivering cooling air into line 104 which passes through a heat exchanger 106, and to the turbine section 110 through a line 112. As known, a combustor 108 is intermediate the compressor 102 and turbine section 110.

The heat exchanger 106 may sit in the bypass duct, such as shown in the FIG. 1 engine 20. Alternatively, the heat exchanger could be placed in other locations.

As mentioned above, it is desirable to cool the compressed air being delivered to the turbine section as cooling air in the heat exchanger 106, however, known heat exchangers have difficulty achieving sufficient cooling. In addition, known heat exchangers face challenges and, in particular, with regard to stresses that are placed on particular areas of the heat exchanger through thermal gradients.

Figure 3A:
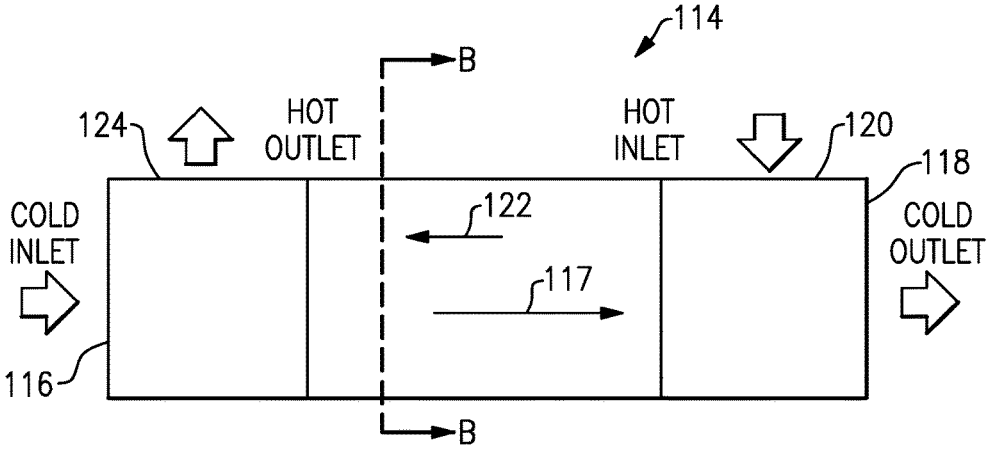
FIG.3A Prior Art
FIG. 3A shows a prior art heat exchanger.

FIG. 3A shows a prior art heat exchanger 114. In the heat exchanger 114, a first fluid enters an inlet 116, passes through passages 117, and leaves through an outlet 118. A second fluid may enter at one end 120, pass through passages 122, and exit through an outlet 124. The fluid in the passages 117 and 122 exchange heat.

Figure 3B:
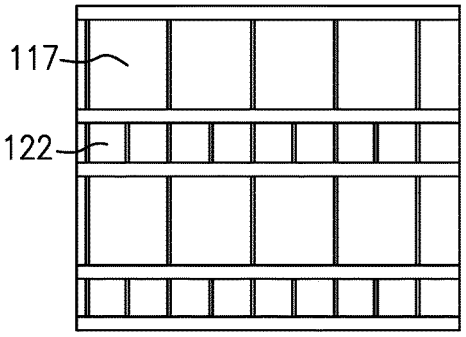
FIG.3B Prior Art
FIG. 3B is a view along line B-B of FIG. 3A.

FIG. 3B shows a cross-section along line B-B of FIG. 3A. As shown, the passages 117 and the passages 122 are spaced from each other by layers, and all have a relatively equal cross-sectional area.

Figure 4A:
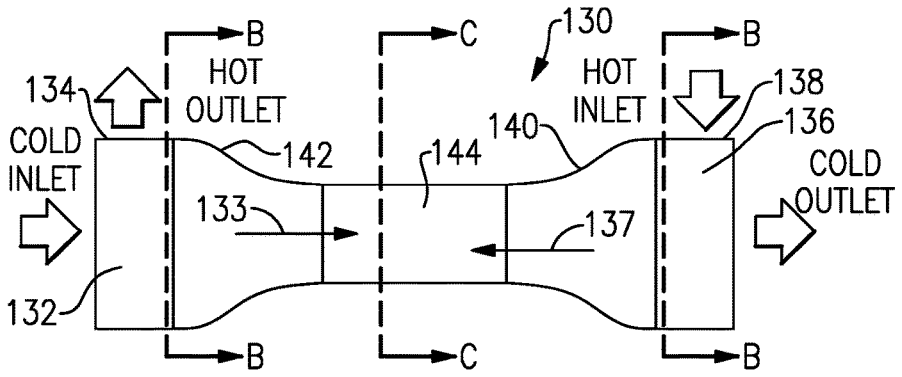
FIG. 4A shows a disclosed heat exchanger embodiment.

FIG. 4A shows a disclosed heat exchanger 130. There is an inlet manifold 132 leading into passages 133 and to an outlet manifold 136. A second fluid enters through an inlet 138, passes through passages 137, and leaves through an exit 134. As can be appreciated, the manifolds 132 and 136 have a relatively great cross-sectional area compared to a core section 144. Transition sections 140 and 142 blend the manifolds into the core area. While one fluid is labelled as "hot" and the other as "cold," those can be switched.

A heat exchanger having the features such as shown in FIG. 4A would be difficult to make by traditional manufacturing techniques. However, utilizing additive manufacturing or precision casting techniques, the flow cross-sectional areas can be manufactured to specific designed shapes and areas.

Figure 4B:
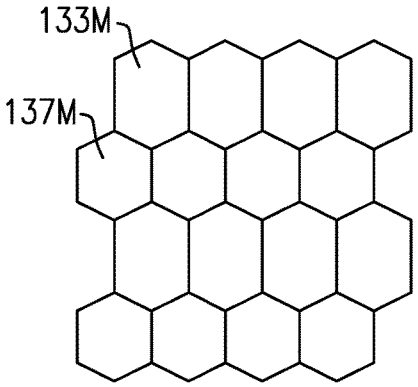
FIG. 4B is a cross-sectional view of a portion of the area along line B-B of FIG. 4A.

FIG. 4B shows a section adjacent to manifold 132, where the manifold 132 is merging into the transition area 142. As can be seen, manifold passages 133M and 137M may be formed to be polygonal and, thus, in contact over a relatively large surface area compared to the FIG. 3B shape.

Figure 4C:
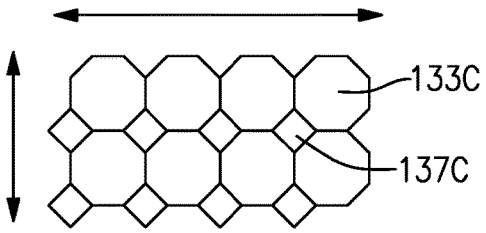
FIG. 4C is a view of a portion of the cross-section along line C-C of FIG. 4A.

FIG. 4C shows a cross-sectional along lines C-C, or in the core. As can be appreciated, the passages 133C and 137C can be made much smaller than in the FIG. 4B manifold sections.

By leaving the manifold sections relatively large, the so-called "entrance" effects or localized heat up at entry into a heat exchanger can be reduced. In addition, the core, having smaller cross-sectional areas, can achieve higher flow velocities and greater heat transfer effectiveness.

Figure 5A:
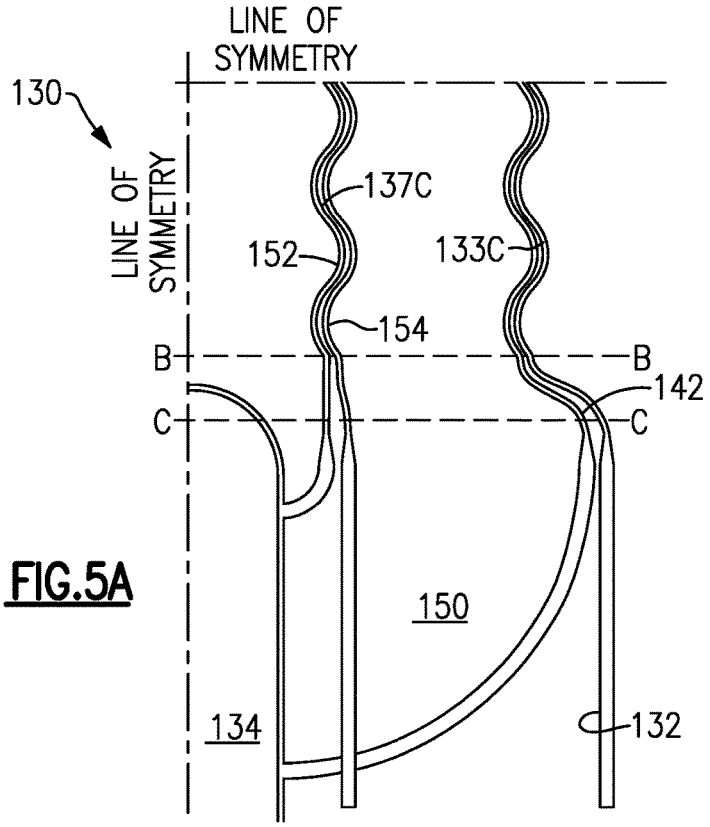
FIG. 5A shows another detail of the heat exchanger embodiment of FIGS. 4A-4C.

FIG. 5A shows a feature of the heat exchanger 130. As shown, the fluid outlet 134 is shown as a manifold leading into a turning section 150, which turns into the transition section 142, and then into the core passage 137C. As can be seen, the second manifold 132 leads into passages 133C, also through a transition section.

Undulations 152 and 154 are formed in the passages 133*c* and 137*c* to increase the cross-sectional area and, thus, the heat transfer.

Figure 5B:
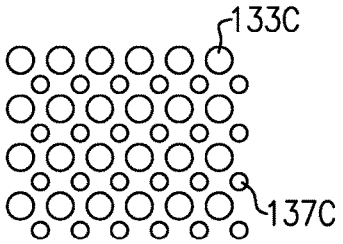
FIG. 5B is a cross-sectional view along line B-B of FIG. 5A.

FIG. 5B is a portion of a cross-section along line B-B. As can be seen, there are relatively small passages 133C interspaced with passages 137C.

Figure 5C:
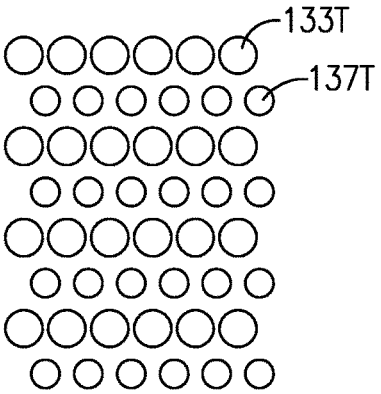
FIG. 5C is a cross-sectional view of a portion of the heat exchanger along line C-C of FIG. 5A.

This can be contrasted to FIG. 5C, which is a cross-section along line C-C, or just as the inlet manifold 132 is turning into the transition portion 142, as is the turning passage 150. As can be seen here, the passages 133T are of greater cross-sectional area than the passages 133C. The same is true of the passages 137T compared to the passages 137C.

The heat exchanger could be described as having a first plurality of fluid passages with an inlet manifold communicating into a core portion, and then an outlet manifold. A second plurality of fluid passages also has an inlet manifold communicating into a core portion, and then into an outlet manifold. The core portion of both the first and second pluralities of fluid passages has a smaller combined cross-sectional area than a combined cross-sectional area of the inlet and outlet manifolds.

The transition portions could also be said to transition between the inlet manifold, the core portion, and the outlet manifold for both the first and second pluralities of fluid passages and the cross-sectional area adjacent the inlet and outlet manifolds mentioned above is taken at the transition portions.

The first plurality of fluid passages and second plurality of fluid passages each have cross-sectional areas which are smaller in the core portion than adjacent the inlet and outlet manifolds.

Thus, the benefits as mentioned above can be achieved.

Figure 6:
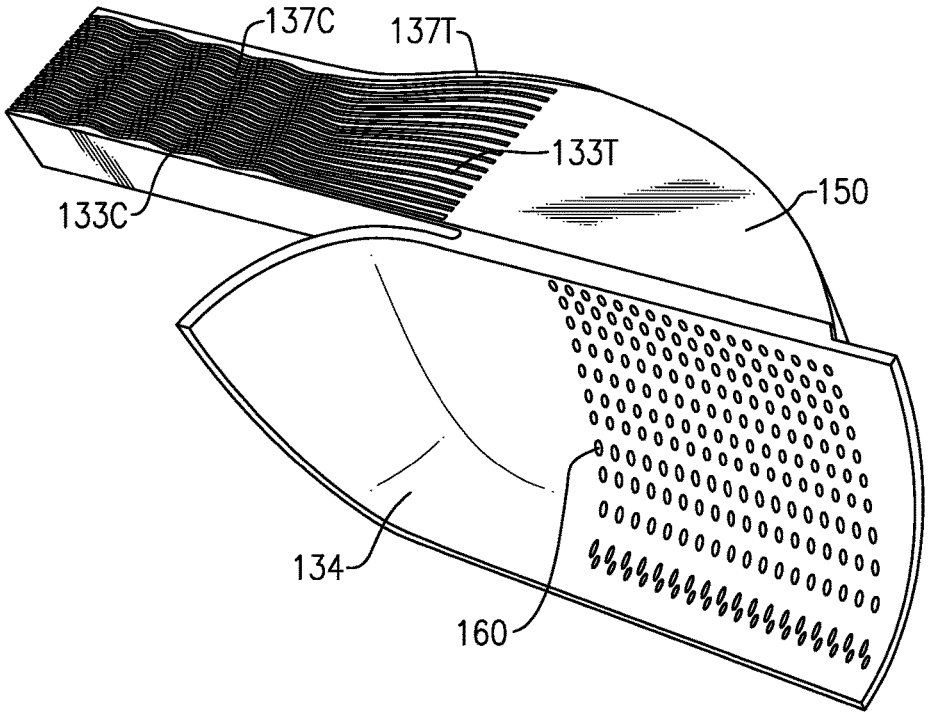
FIG. 6 shows a portion of the heat exchanger of the heat exchanger embodiment of FIGS. 4A-4C, 5A-5C.

FIG. 6 shows a portion of the manifold 134 having openings 160, which will communicate into the turning portion 150, and eventually into the passages 137T. Downstream of passages 137T are passages 137C. Similarly, there are transition passages 133T that merge with the passages 133C. One can also see undulations.

Figure 7A:
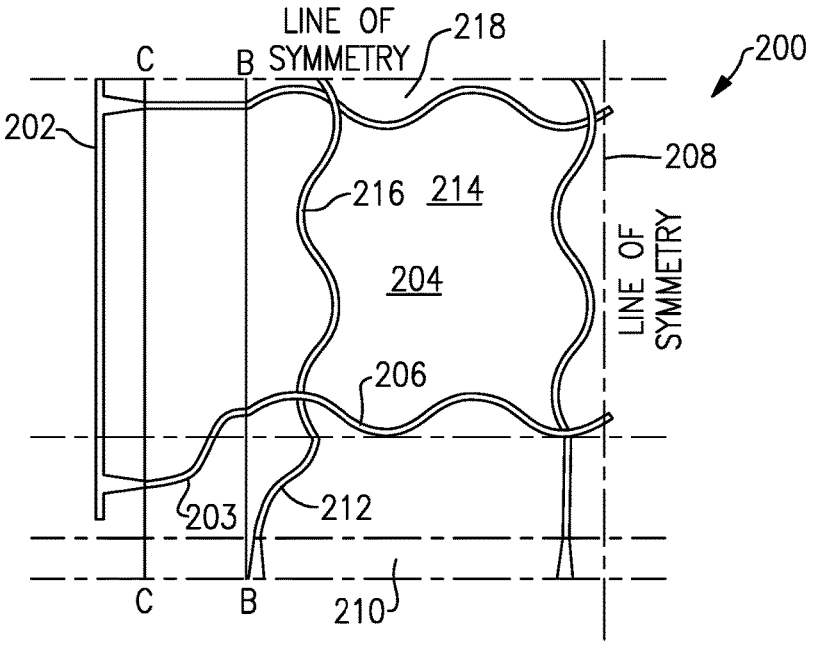
FIG. 7A shows an alternative embodiment.

FIG. 7A shows an alternative embodiment 200N the heat exchanger shown in FIGS. 4-6, the two fluids flow through the core in a parallel direction. In the FIG. 7A heat exchanger 200, the flows are generally along perpendicular directions. This is a so-called cross-flow heat exchanger. As shown, an inlet 202 for one fluid merges into passages 204, having undulations 206. The passages 204 eventually reach an outlet manifold 208. A transition zone 203 is shown.

The second fluid passes into an inlet manifold 210 having transition zone 212 leading into the passages 214. Again, undulations 216 increase the heat transfer between the passages 204 and 214. The passages 214 then communicate to the outlet manifold 218.

Figure 7B:
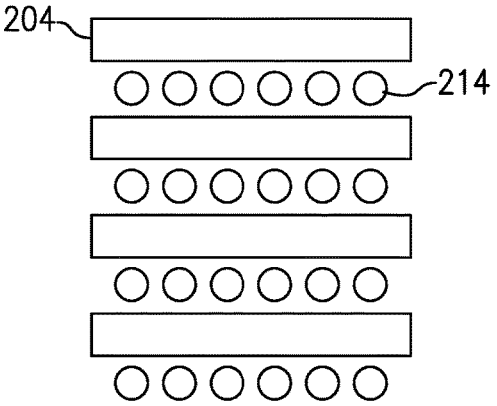
FIG. 7B is a partial cross-sectional view along line B-B of FIG. 7A.

FIG. 7B shows that the passages 204 and 214 flow in distinct directions. As can be appreciated, FIG. 7B is taken along a portion of the heat exchanger near the core.

Figure 7C:
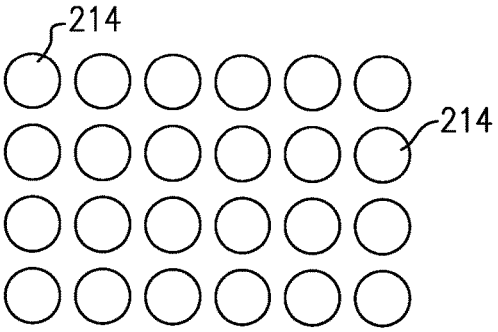
FIG. 7C is a partial cross-sectional view along line C-C of FIG. 7A.

FIG. 7C shows the inlet manifold 202 for one of the flow passages. Only passages 214 are shown. As can be seen, the passages 214 in the FIG. 7C location are of larger cross-section than are the passages 214 of FIG. 7B.

Figure 8:
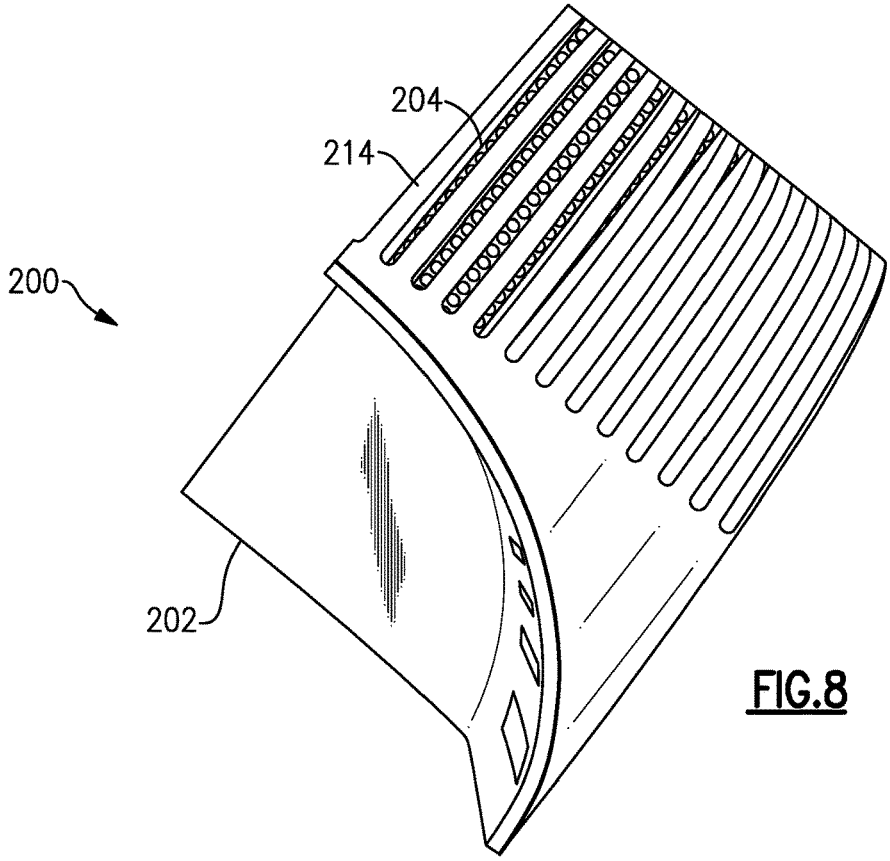
FIG. 8 shows a portion of the FIG. 7A heat exchanger.

FIG. 8 shows a portion of the heat exchanger 200. In particular, an inlet manifold 202 leads into the passages 214. Other passages 204 flow in a counter-flow direction.

The heat exchangers may be formed by precision casting techniques. As an example, a casting technique known as investment casting of refractory metal core may be utilized. Tungsten and other refractory metals may be utilized in a so-called lost metal technique to form the internal passages. Thus, the complex shapes and inter-fitting flow passages, as disclosed above, may be achieved with this method.

Figure 9:
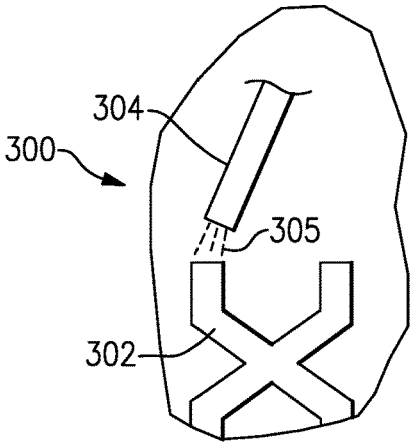
FIG. 9 schematically shows the formation of a heat exchanger utilizing one disclosed method.

Alternatively, additive manufacturing techniques may be utilized. Additive manufacturing is a known process, which allows the build-up of very complex shapes by laying down material in layers. This is shown schematically at 300 in FIG. 9. An intermediate heat exchanger 302 is being formed by an additive manufacturing tool 304 placing down material 305 layers.

Although an embodiment of this invention has been disclosed, a worker of ordinary skill in this art would recognize that certain modifications would come within the scope of this invention. For that reason, the following claims should be studied to determine the true scope and content of this invention.

Any type of additive manufacturing process may be utilized. A worker of ordinary skill in the art would be able to select an appropriate known additive manufacturing process based upon the goals of this disclosure.

Thus, utilizing precision casting or additive manufacturing techniques, a worker of ordinary skill in the art would be able to achieve specific arrangements of inter-fitting flow passages as desired for a particular heat exchanger application.

The invention claimed is:

1. A heat exchanger comprising:

a first plurality of fluid passages having an inlet manifold communicating into a core portion, and then an outlet manifold; and a second plurality of fluid passages having an inlet manifold communicating into a core portion, and then into an outlet manifold and said core portions of both said first and second pluralities of fluid passages having smaller cross-sectional areas than cross-sectional areas of said inlet and outlet manifolds.

2. The heat exchanger as set forth in claim 1, wherein transition portions transition between said inlet manifold and said core portion and between said core portion and said outlet manifold for both said first and second pluralities of fluid passages.

3. The heat exchanger as set forth in claim 2, wherein said first plurality of fluid passages and second plurality of fluid passages each having cross-sectional areas which are smaller in said core portion than adjacent said inlet and outlet manifolds.

4. The heat exchanger as set forth in claim 2, wherein said inlet and outlet manifolds of one of said first and second pluralities of fluid passages communicates with a turning section which turns into said transition portion, and the other of said first and second set of pluralities of fluid passages extending generally along a common direction with a flow direction through said transition portion.

5. The heat exchanger as set forth in claim 2, wherein said first and second pluralities of fluid passages are formed with undulations in said core portion.

6. The heat exchanger as set forth in claim 2, wherein said heat exchanger is a cross-flow heat exchanger, with the flow in one of said first and second plurality of fluid passages being generally perpendicular to a flow direction through the other of said first and second plurality of fluid passages.

7. The heat exchanger as set forth in claim 1, wherein said inlet and outlet manifolds of one of said first and second pluralities of fluid passages communicates with a turning section which turns into a transition portion, and the other of said first and second set of pluralities of fluid passages communicating generally along a common direction with a flow direction through said core portions.

8. The heat exchanger as set forth in claim 1, wherein said first and second pluralities of fluid passages are formed with undulations in said core portion.

9. The heat exchanger as set forth in claim 1, wherein said heat exchanger is a cross-flow heat exchanger, with the flow in one of said first and second plurality of fluid passages being generally perpendicular to a flow direction through the other of said first and second plurality of fluid passages.

10. A gas turbine engine comprising:

a compressor section and a turbine section;

a heat exchanger for cooling air from said compressor section being passed to said turbine section;

the heat exchanger including a first plurality of fluid passages having an inlet manifold communicating into a core portion, and then an outlet manifold; and a second plurality of fluid passages having an inlet manifold communicating into a core portion, and then into an outlet manifold and said core portions of both said first and second pluralities of fluid passages having smaller cross-sectional areas than cross-sectional areas adjacent said inlet and outlet manifolds.

11. The gas turbine engine as set forth in claim 10, wherein transition portions transition between said inlet manifold and said core portion and between said core portion and said outlet manifold for both said first and second pluralities of fluid passages.

12. The gas turbine engine as set forth in claim 11, wherein said first plurality of fluid passages and second plurality of fluid passages each having cross-sectional areas which are smaller in said core portion than adjacent said inlet and outlet manifolds.

13. The gas turbine engine as set forth in claim 11, wherein said inlet and outlet manifolds of one of said first and second pluralities of fluid passages communicates with a turning section which turns into said transition portion, and the other of said first and second set of pluralities of fluid passages communicating generally along a common direction with a flow direction through said transition portion.

14. The gas turbine engine as set forth in claim 11, wherein said first and second pluralities of fluid passages are formed with undulations in said core portion.

15. The gas turbine engine as set forth in claim 11, wherein said heat exchanger is a cross-flow heat exchanger, with the flow in one of said first and second plurality of fluid passages being generally perpendicular to a flow direction through the other of said first and second plurality of fluid passages.

16. The gas turbine engine as set forth in claim 10, wherein said first plurality of fluid passages and second plurality of fluid passages each having cross-sectional areas which are smaller in said core portion than adjacent said inlet and outlet manifolds.

17. The gas turbine engine as set forth in claim 14, wherein said first and second pluralities of fluid passages are formed with undulations in said core portion.

18. A method of forming a heat exchanger comprising:

forming a first plurality of fluid passages having an inlet manifold communicating into a core portion, and then an outlet manifold; and forming a second plurality of fluid passages having an inlet manifold communicating into a core portion, and then into an outlet manifold and said core portions of both said first and second pluralities of fluid passages having smaller cross-sectional areas than cross-sectional areas adjacent said inlet and outlet manifolds.

19. The method as set forth in claim 18, wherein loss mold refractory metal cores are utilized to form said first and second plurality of fluid passages.

20. The method as set forth in claim 18, wherein additive manufacturing techniques are utilized to form said first and second plurality of fluid passages.

* * * * *